United States Patent [19]

Purnell

[11] Patent Number: 5,011,149

[45] Date of Patent: Apr. 30, 1991

[54] JOYSTICK

[76] Inventor: Victor J. Purnell, 1 Pantddu Cottages, Christchurch, Aberbeeg Gwent, United Kingdom

[21] Appl. No.: 488,073

[22] PCT Filed: Dec. 21, 1988

[86] PCT No.: PCT/GB88/01139

§ 371 Date: Jul. 12, 1990

§ 102(e) Date: Jul. 12, 1990

[87] PCT Pub. No.: WO89/06022

PCT Pub. Date: Jun. 29, 1989

[30] Foreign Application Priority Data

Dec. 22, 1987 [GB] United Kingdom ..... 8729845

[51] Int. Cl.[5] ..... A63B 71/00

[52] U.S. Cl. ..... 273/148 B

[58] Field of Search ..... 273/148 R, 148 B; 340/709, 825.99

[56] References Cited

U.S. PATENT DOCUMENTS

| | | | |
|---|---|---|---|
| 3,268,680 | 8/1966 | Anderson | 200/61.88 |
| 4,422,640 | 12/1983 | Tamarkin | 273/148 R |
| 4,504,059 | 3/1985 | Weinreib | 273/148 B |
| 4,520,894 | 6/1985 | Hensler | 200/6 A |
| 4,573,682 | 3/1986 | Mayon | 273/148 B |

*Primary Examiner*—Edward M. Coven
*Assistant Examiner*—Raleigh W. Chiu
*Attorney, Agent, or Firm*—David P. Gordon

[57] ABSTRACT

A joystick controller comprises a base to which an upright element is fixed, and a tubular joystick positioned around the fixed element and pivotally mounted to the base. Electrical contacts are carried by the joystick and make selectively with the fixed element depending on the direction in which the joystick is tilted. The base has a curved bottom to seat equally in the right or left and of the user, but has portions which can be hinged open to reveal a flat bottom which will sit on a desktop and be retained thereon by suction pads.

18 Claims, 2 Drawing Sheets

FIG. 1.
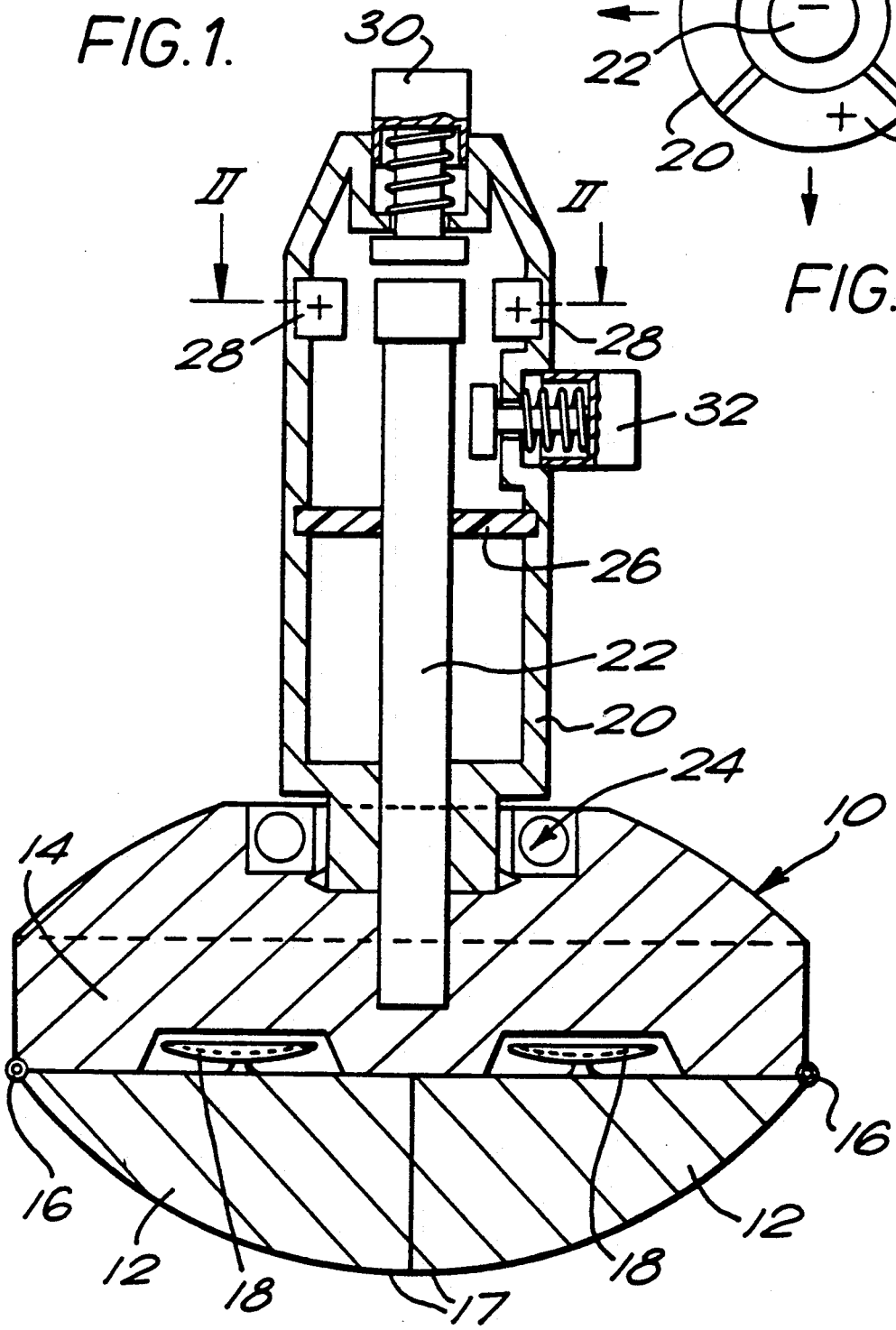
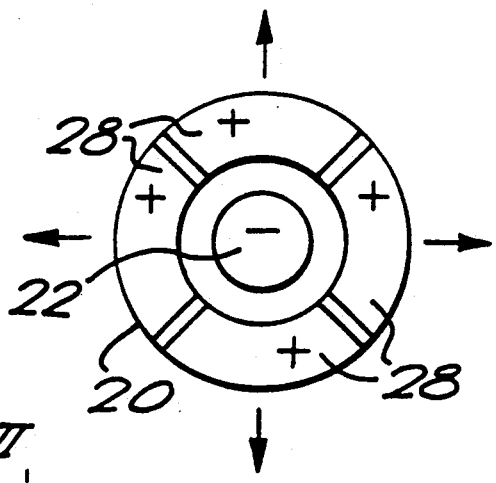
FIG. 2.

JOYSTICK

BACKGROUND OF THE INVENTION

This invention relates to a joystick controller, e.g. for use with computers when playing games.

In general known joystick controllers are either hand-held or arranged for mounting on the desk top and provided with suction pads for holding them down. The hand-held joystick controllers are generally suited to right handed people only.

SUMMARY OF THE INVENTION

In accordance with this invention as seen from one aspect, there is provided a joystick controller comprising a base having a joystick projecting upwardly therefrom, the base being shaped for holding in the palm of the hand but having a portion which is displaceable to enable the joystick to be mounted on a desktop, the base being provided with a suction pad for holding the joystick to the desktop when said portion is appropriately displaced.

Preferably the base of the joystick is formed with a curved bottom suited equally for holding in the right or left hand. The displaceable portion of the base may be hinged outwards to form a flat bottom to the base, suited for standing on the desktop. Preferably there are two portions which hinge outwards in opposite directions and which are provided with respective suction pads.

Known joystick controllers generally include microswitches, leaf switches or small flexible tabs for effecting the different electrical contacts. All of these have limited reliability. The electrical contacts are generally disposed in the base of the joystick controller, with a tendency for the base to be rather large.

In accordance with this invention as seen from another aspect, there is provided a joystick controller, which comprises a base, an elongate element fixed to the base and projecting upwardly therefrom, a tubular joystick positioned around the fixed elongate element and pivotally mounted to the base, and electrical contacts carried by one of the tubular joystick and the elongate element arranged to make selectively with the other of the tubular joystick and the element depending on the direction in which the tubular joystick is tilted.

By removing the electrical contacts from the base and disposing them within the joystick itself, more room is left in the base for other components such as autofire circuitry. Also or instead, the base may be made smaller to suit a smaller hand.

The electrical contacts are preferably direct-acting so as to be more reliable. Preferably the contacts are adjustable for contact point distance so that the feel of the joystick controller can be adjusted to the user's preference. Further with these types of electrical contact, a "fire" button can be mounted at the top of the joystick, which is preferable to being positioned on the base.

Embodiments of this invention will now be described by way of examples only and with reference to the accompanying

BRIEF DESCRIPTION OF THE FIGURES

FIG. 1 is a schematic vertical section through one embodiment of joystick controller in accordance with the invention;

FIG. 2 is a cross-section on the line II—II of FIG. 1;

DETAILED DESCRIPTION OF THE PREFERRED EMBODIMENT

Figure 3:
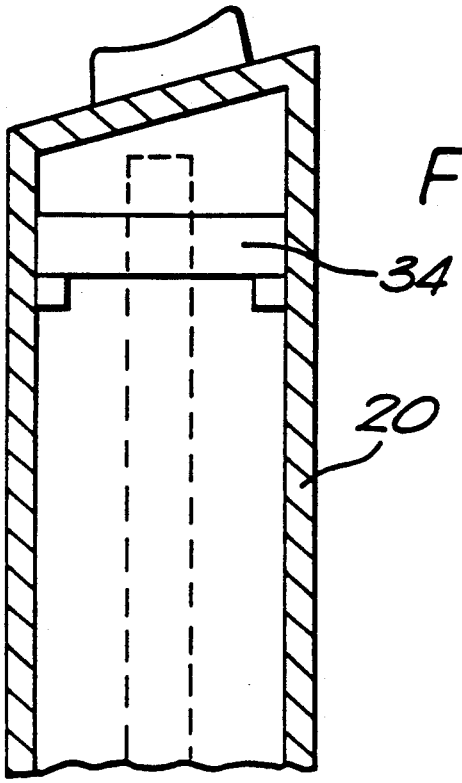
FIG. 3 is a schematic vertical section through the upper end of a modified joystick.

Referring to FIG. 1, there is shown a joystick 20 projecting upwardly from the base. The base 10 has two bottom portions 12, 12 which are hinged to the upper portion 14 of the base at opposite edges 16, 16. The upper portion 14 has a flat bottom periphery and the hinged portions 12, 12 have flat surfaces which close onto the flat bottom of upper portion 14, as shown. When the hinged portions 12, 12 are closed as shown, they present a convex curved bottom surface 17 to the base, which is shaped for the joystick to be held comfortably in the palm of the hand, equally whether the right or left hand. However, when the portions 12, 12 of the base are hinged outwards in opposite directions from the portion 14, a generally flat bottom to the joystick base is presented, for it to be stood on a desktop. Further, the flat surfaces of the hinged portions 12, 12 are provided with suction pads 18, 18 for holding the joystick controller firmly to the desktop.

Thus the joystick controller has particular versatility, being suited for holding equally in the right or left hand or for mounting firmly on the desktop.

The joystick controller comprises a centre pole 22 fixed to the upper portion 14 of the base and projecting vertically upwards therefrom. The joystick 20 itself comprises a tubular member disposed around the centre pole, and journalled to the base portion 14 by means of a self-aligning bearing 24. A resilient ring 26 encircles the pole 22 and serves to centre the joystick 20 concentrically about the pole 22 when the user's grip on the joystick 20 is released.

Referring particularly to FIG. 2 of the drawings, an annular ring is mounted to the inner surface of the tubular joystick member, and divided at intervals of 90° around its periphery to form four electrical contacts 28. According to the direction in which the joystick 20 is tilted relative to the base and centre pole, one or another (or any adjacent pair) of the contacts 28 will make with the centre pole at the top of the latter, thus completing a respective electrical circuit (or pair of circuits). As shown in FIG. 1, "fire" buttons 30, 32 may be provided, one mounted in the closed top end of the joystick 20 and the other in the side of the joystick 20, each being depressible against a spring bias to make with the top or side of the centre pole 22.

Figure 4:
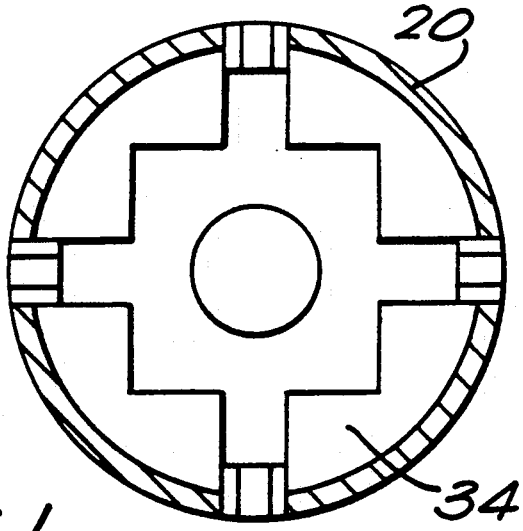
FIG. 4 is a section on the line IV—IV of Fig. 3 shown with the electrical contacts removed from their carrier insert.
Figure 5:
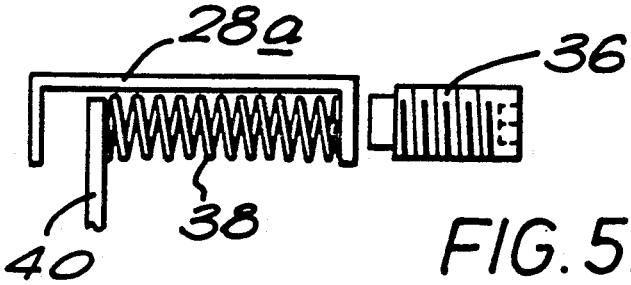
FIG. 5 is a schematic view of the components of the electrical contacts.

In the modified embodiment shown in FIGS. 3 to 5, the "tilt" contacts are adjustable. Thus, the tubular joystick element 20 is provided with a moulded plastics insert 34 which mounts four contact plates e.g. 28*a* and an adjustment screw 36. This adjustment screw bears against the outer, inturned end of the contact plate 28*a*, and compression spring 38 acting between this outer end of the contact plate and an abutment 40 of the insert 34. Thus tightening of the screw 36 reduces the contact point distance between the inner inturned end of the contact plate and the centre pole 22.

I claim:

1. A joystick controller, which comprises a base (10), an elongate element (22) fixed to the base and projecting upwardly therefrom, a tubular joystick (20) positioned around the fixed elongate element and pivotally mounted to the base, and electrical contacts (28) carried by one of the tubular joystick and elongate element, and arranged to make selectively with the other one of the tubular joystick and elongate element depending on the direction in which the tubular joystick is tilted.

2. A joystick controller as claimed in claim 1, further comprising resilient means acting between the elongate element (22) and the joystick (20) to bias the joystick to a central position relative to the elongate element.

3. A joystick controller as claimed in claim 2, in which the electrical contacts (28) are formed by an annular ring mounted to the inner surface of the tubular joystick, which annular ring is divided at intervals around its periphery.

4. A joystick controller as claimed in claim 3, further comprising a control button, mounted on the top and/or side of the tubular joystick, which button is depressible to make electrical contact with the elongate element.

5. A joystick controller as claimed in claim 2, in which the electrical contacts (28*a*) are individually mounted to the tubular joystick and are adjustable in position relative to the elongate element.

6. A joystick controller as claimed in claim 5, further comprising a control button, mounted on the top and/or side of the tubular joystick, which button is depressible to make electrical contact with the elongate element.

7. A joystick controller as claimed in claim 2, further comprising a control button, mounted on the top and/or side of the tubular joystick, which button is depressible to make electrical contact with the elongate element.

8. A joystick controller as claimed in claim 1 further comprising a control button, mounted on the top and/or side of the tubular joystick, which button is depressible to make electrical contact with the elongate element.

9. A joystick controller as claimed in claim 1, in which the electrical contacts (28) are formed by an annular ring mounted to the inner surface of the tubular joystick, which annular ring is divided at intervals around its periphery.

10. A joystick controller as claimed in claim 9, further comprising a control button, mounted on the top and/or side of the tubular joystick, which button is depressible to make electrical contact with the elongate element.

11. A joystick controller as claimed in claim 1, in which the electrical contacts (28*a*) are individually mounted to the tubular joystick and are adjustable in position relative to the elongate element.

12. A joystick controller as claimed in claim 11, further comprising a control button, mounted on the top and/or side of the tubular joystick, which button is depressible to make electrical contact with the elongate element.

13. A joystick controller, which comprises a base (10) having a joystick (10) projecting upwardly therefrom, the base being shaped for holding in the palm of the hand but having a portion (12) which is displaceable to enable the joystick to be mounted on a desktop, the base being provided with a suction pad (18) for holding the joystick to the desktop when said portion is appropriately displaced.

14. A joystick controller as claimed in claim 13, in which the base (10) if formed with a convex-curved bottom suited equally for holding in the right or left hand.

15. A joystick controller as claimed in claim 14, in which the displaceable portion (12) hinges outwards to form a flat bottom to the base, suited for standing on the desktop.

16. A joystick controller as claimed in claim 15, in which there are two portions (12) which hinge outwards in opposite directions and which are provided with respective suction pads (18).

17. A joystick controller as claimed in claim 13, in which the displaceable portion (12) hinges outwards to form a flat bottom to the base, suited for standing on the desktop.

18. A joystick controller as claimed in claim 17, in which there are two portions (12) which hinge outwards in opposite directions and which are provided with respective suction pads (18).

* * * * *